US005507625A

United States Patent [19]

Dudeck

[11] Patent Number: 5,507,625

[45] Date of Patent: Apr. 16, 1996

[54] LIQUID RING PUMPS

[75] Inventor: Carl G. Dudeck, Newton, Conn.

[73] Assignee: The Nash Engineering Company, Trumbull, Conn.

[21] Appl. No.: 422,060

[22] Filed: Apr. 14, 1995

[51] Int. Cl.[6] ..... F04C 19/00

[52] U.S. Cl. ..... 417/68; 277/57

[58] Field of Search ..... 417/68; 277/55, 277/56, 57, 135

[56] References Cited

U.S. PATENT DOCUMENTS

| | | | |
|---|---|---|---|
| 4,334,830 | 6/1982 | Haavier | 417/68 |

FOREIGN PATENT DOCUMENTS

| | | | |
|---|---|---|---|
| 852435 | 2/1940 | France | 417/68 |
| 618414 | 8/1935 | Germany . | |
| 2309474 | 2/1973 | Germany . | |
| 2731451 | 7/1977 | Germany . | |
| 3711121 | 12/1988 | Germany . | |
| 22478 | 9/1930 | Netherlands . | |
| 197805 | 5/1978 | Netherlands | 417/68 |
| 361310 | 1/1973 | U.S.S.R. | 417/68 |
| 858422 | 4/1957 | United Kingdom . | |
| 1500200 | 3/1975 | United Kingdom . | |

*Primary Examiner*—Richard A. Bertsch
*Assistant Examiner*—Roland G. McAndrews, Jr.
*Attorney, Agent, or Firm*—Fish & Neave; Robert R. Jackson

[57] ABSTRACT

To decrease gas leakage across the cantilevered axial end of the hub of a liquid ring pump rotor which has a central recess in that end of the hub, the adjacent port structure is provided with a protrusion which extends axially part way into the recess in the rotor hub. A relatively small clearance is provided between the radially outer surface of the protrusion and the radially adjacent inner surface of the recess. This clearance is filled with liquid and thereby increases the area of the seal at the adjacent axial end of the rotor hub.

5 Claims, 2 Drawing Sheets

LIQUID RING PUMPS

BACKGROUND OF THE INVENTION

This invention relates to liquid ring gas pumps, and more particularly to liquid ring gas pumps with ports for admitting and emitting gas at an axial end of the rotor in the pump.

Liquid ring gas pumps with ports at an axial end of the rotor are well known as shown, for example, by the first several Figures in Dardis et al. U.S. Pat. No. 5,213,479. In many of these pumps the rotor is mounted on a cantilevered drive shaft. This means that the drive shaft has bearings adjacent only one axial end of the rotor. The shaft does not extend beyond the other axial end of the rotor to a second bearing adjacent that other axial end. Instead, the rotor is typically secured to the cantilevered end of the shaft via any of several types of fasteners such as a nut threaded on the end of the shaft, a bolt threaded into the end of the shaft, etc. The fastener may be recessed in the adjacent end of the rotor (e.g., to keep the cantilevered shaft as short as possible, to keep the fastener away from the port structure (described below) in order to help simplify the port structure, etc.).

Adjacent the axial end of the rotor that does not have an adjacent shaft bearing, pumps of the type described above typically have a port structure. The port structure generally has at least one gas inlet port and one gas outlet port. Each of these ports is radially spaced from the longitudinal axis of the rotor drive shaft (which longitudinal axis may have to be extended from the actual end of the shaft to reach the port structure). In addition, these ports are spaced from one another in the circumferential direction around the above-mentioned longitudinal axis. The gas inlet port is used to admit gas at a relatively low pressure to the working spaces of the pump, which are between circumferentially spaced, radially outwardly and axially extending blades of the rotor. As the rotor rotates, it conveys the gas it receives from the inlet port to the circumferential location of the outlet port. In the process of conveying the gas in this manner, the rotor also compresses the gas being conveyed. This is done in cooperation with a quantity of liquid (typically water) maintained in the pump. The rotor blades engage this liquid and form it into a recirculating ring which provides the radially outer boundary of the working spaces of the pump. The liquid ring is somewhat eccentric to the rotor so that the size of each working space changes as that working space moves around the rotor axis. This change in working space size is used to compress gas in the pump. When the gas has been compressed and conveyed to the outlet port, it exits from the rotor via the outlet port.

In the typical pump of the type described above the axial end of the rotor which is adjacent to the port structure is substantially planar. Of course, the working spaces of the pump open through this rotor axial end plane, and the above-mentioned recess for the rotor fastener also opens through this plane. The adjacent axial end face of the port structure is also substantially planar and axially spaced from the rotor end plane by a relatively small, substantially planar clearance. Again, the gas inlet and outlet ports open through the port structure axial end plane, and a liquid supply port may also open through this plane to communicate with the above-mentioned recess in the rotor. Liquid (typically water, but in any event the same as the liquid used in the above-described recirculating ring) is forced into the planar clearance between the facing rotor end and port structure end planes to help prevent gas from leaking around the axial end of the rotor from high pressure to low pressure regions in the pump. This liquid is not static in this clearance, but rather flows continuously through the clearance to enter the recirculating ring.

While the above-described liquid sealing of the axial end of the rotor is effective to a significant degree, there is room for improvement in this aspect of the pump design. Moreover, the effectiveness of this rotor end sealing technique is influenced to a substantial degree by the area of the axial end of the rotor that is opposite a corresponding axial end of the port structure, especially in the annulus of rotor axial end surface that surrounds the above-mentioned rotor fastener recess. For more effective sealing it is desirable to increase the radial width of this annulus. But other considerations tend to take away from this radial width. Examples of these other considerations are a desire to keep the overall dimensions of the pump as small as possible, and a desire to make the rotor fastener recess as large as possible. A larger rotor fastener recess improves access to the recessed fastener (e.g., facilitating use of standard fasteners and standard tools which may not be optimized for slenderness). A larger rotor fastener recess may also make it possible to reduce the amount by which the drive shaft diameter has to be reduced at the fastener, thereby allowing the use of a larger fastener and avoiding weakening of the shaft at the fastener. A larger rotor fastener recess may also allow new types of fasteners to be used. For example, a collet-type fastener can be tightened around the drive shaft without the shaft being specially adapted in any way to receive the fastener. This is highly desirable because it means that the shaft can be a completely standard electric motor shaft. The motor does not have to be specially made (or subsequently modified) for this use. Also the shaft diameter is not reduced and thereby weakened in any way at the fastener.

In view of the foregoing, it is an object of this invention to improve rotor end sealing in liquid ring pumps of the type described above.

It is a more particular object of this invention to allow the radial width of the planar annulus around the rotor fastener recess in the above-described pumps to be reduced without losing rotor end sealing, and preferably even with an increase in rotor end sealing.

SUMMARY OF THE INVENTION

These and other objects of the invention are accomplished in accordance with the principles of the invention by providing an axially extending projection or protrusion (e.g., an annular boss or flange) on the axial end of the port structure which is adjacent to the rotor. This protrusion is concentric with the rotor axis and extends into the rotor fastener recess. The radially outer surface of the port member protrusion is radially spaced from a complementary surface on the radially inner surface of the rotor fastener recess by an annular clearance which has a relatively small radial dimension. This radial dimension is comparable to the axial dimension typically used for the planar axial clearance between the end of the rotor and the facing end of the port structure. The above-described annular clearance between the port structure protrusion and the inner surface of the rotor fastener recess communicates with and significantly extends the conventional planar clearance. Sealing liquid is supplied to all of these clearances. Because of the added clearance area provided by this invention, the size of the rotor fastener recess can be increased with no loss of sealing effectiveness, even though increasing the size of the rotor fastener recess reduces the area of the conventional planar clearance seal.

Indeed, sealing effectiveness may even increase despite a decrease in the conventional planar clearance seal area. It is also believed helpful that the port member protrusion makes potential leakage paths more tortured, rather than simply planar.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
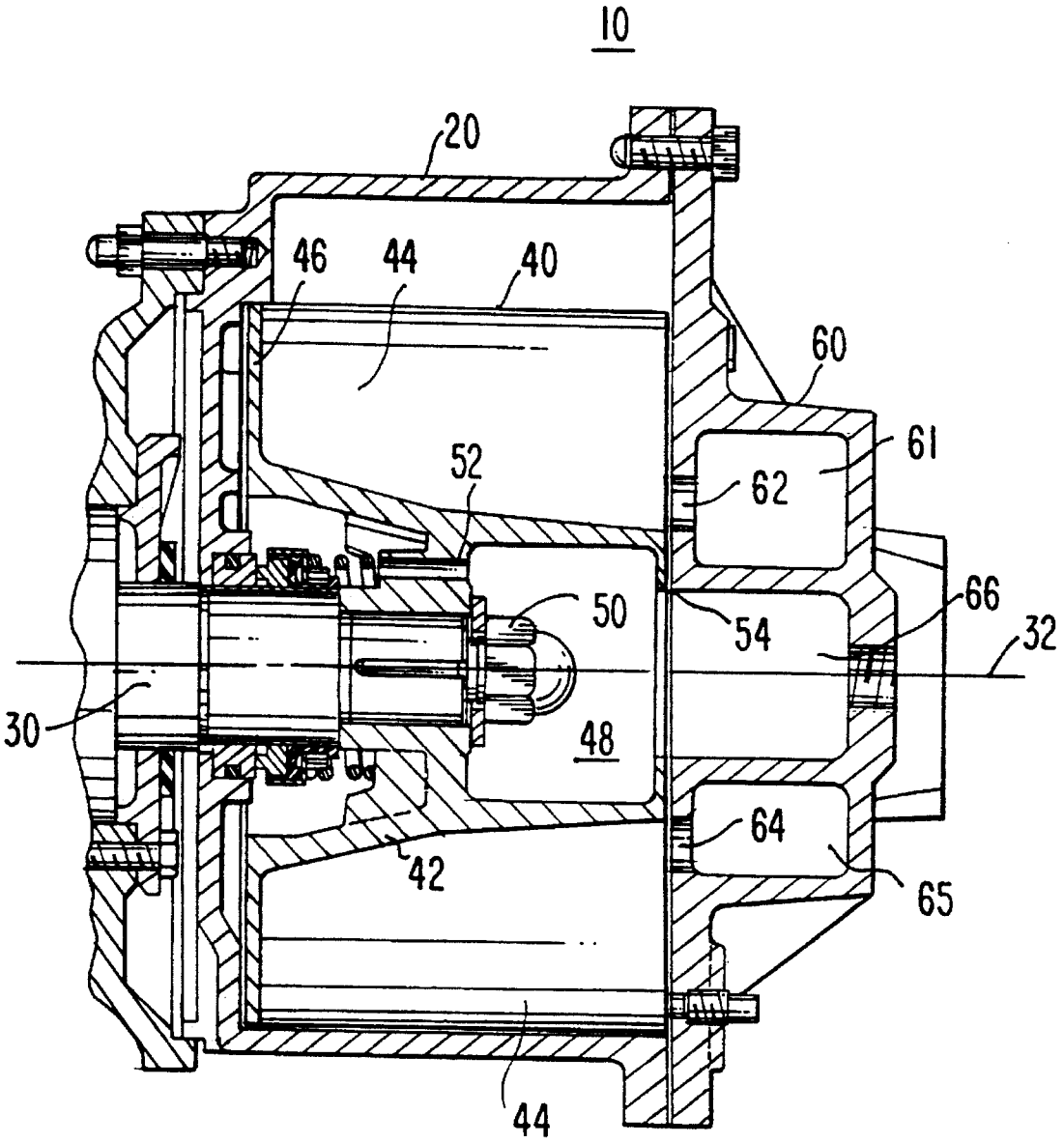
FIG. 1 (PRIOR ART)
FIG. 1 is a sectional view of an illustrative prior art liquid ring pump of the type improved upon by the present invention.

FIG. 1 shows an example of a prior art pump of the type which is described in general terms in the background section of this specification. As shown in FIG. 1 pump 10 includes a stationary annular housing 20. A rotatable shaft 30 extends into housing 20 from the left. A rotor 40 is secured to shaft 30 by a fastener 50. In this case fastener 50 is an acorn nut threaded onto a threaded end of shaft 30. A key and keyway connection may also be provided between shaft 30 and rotor 40 to ensure that the rotor rotates with the shaft about the central longitudinal axis 32 of the shaft and rotor.

Rotor 40 has a central hub portion 42 and a plurality of circumferentially spaced blades 44 extending radially outward from and axially along the hub. At the left-hand end of rotor 40 the axial ends of all of blades 44 are interconnected by a planar shroud portion 46 of the rotor. At the other (right-hand) end of the rotor the spaces between adjacent blades 44 are open for communication with the gas inlet (62) and gas outlet (64) ports in port structure 60. The hub portion 42 of rotor 40 has a central recess 48 in which fastener 50 is disposed. Recess 48 opens toward port structure 60.

Port structure 60 is mounted on the right-hand end of housing 20 so that, like housing 20, port structure 60 is stationary. Gas to be compressed is supplied to the pump via gas inlet passageway 61 in port structure 60. This gas flows into the working spaces of the pump (between adjacent rotor blades 44) via gas inlet port 62. After conveyance and compression in the pump, the pressurized gas exits from the working spaces via gas outlet port 64 and gas outlet passageway 65 in port structure 60. The rotor cooperates with a ring of liquid (not shown) inside housing 20 to convey and compress the gas. This liquid ring is formed and recirculated by contact with rotor blades 44. As can be seen, housing 20 is somewhat eccentric to rotor 40. This makes the liquid ring similarly eccentric to the rotor, which causes the space between each adjacent pair of rotor blades that is not occupied by liquid to alternately expand and contract as the rotor rotates and the above-mentioned space ("the working space") therefore moves around the pump. This change in working space volume is used by the pump to compress the gas being conveyed through the pump.

Pressurized liquid is introduced into the pump via passageway 66 in port structure 60. This liquid flows from port structure passageway 66 into rotor fastener recess 48. A passageway 52 is provided through the hub portion 42 of rotor 40 to allow some of this liquid to reach the left-hand end of the rotor to help seal that end of the pump. This left-hand portion of the pump is not significant to the present invention and so it will not be discussed further. Other liquid from pump regions 48 and 66 flows radially outward through a relatively thin planar clearance between the substantially planar right-hand axial end surface of rotor 40 and the adjacent substantially planar left-hand axial end surface of port structure 60. For example, clearance 54 may have an axial dimension of about 0.002 to about 0.015 inches. This clearance dimension, which may be selected in part on the basis of the overall size of the pump, is shown enlarged in FIG. 1 for greater clarity in the illustration. The intention of the pump design is for liquid to substantially fill clearance 54 and thereby substantially prevent gas from leaking across the axial end of rotor hub 42 which provides one surface of clearance 54.

It will be noted that, because of the presence of rotor fastener recess 48, clearance 54 is a planar annulus around recess 48. The radial width of this annulus is very important to the effectiveness of the above-described liquid seal in clearance 54. As the radial width of this annulus decreases, the effectiveness of the liquid seal in this area also decreases. Heretofore the need to maintain an effective seal in clearance 54 has militated against increasing the size of rotor fastener recess 48. However, increasing the size of this recess would be highly desirable to improve access to fastener 50 (when port structure 60 is removed), to allow a larger fastener 50 to be used, to allow a different type of fastener to be used, to reduce the amount by which the diameter of shaft 30 must be reduced for the fastener, etc. The present invention allows these conflicting objectives to be attained, as will now be explained with reference to FIGS. 2 and 3.

Figure 2:
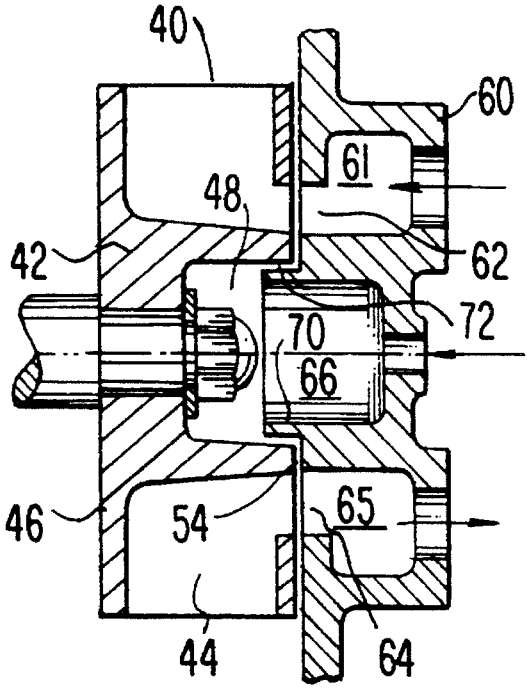
FIG. 2 is a simplified view similar to a portion of FIG. 1 showing a first illustrative embodiment of this invention.

In accordance with this invention as shown, for example, in FIG. 2, a protrusion 70 (in this case an annular boss or flange) is added to port structure 60 so that the protrusion extends axially part way into rotor fastener recess 48. The radially outer surface of protrusion 70 is cylindrical and concentric with rotor axis 32. The radially adjacent inner surface of recess 48 is similarly cylindrical and concentric with axis 32. These two cylindrical surfaces are spaced apart by a small radial distance (e.g., about 0.002 to about 0.015 inches, which dimension may be influenced in part by the overall size of the pump). Thus a substantially cylindrical clearance 72 is formed between these two cylindrical surfaces. Cylindrical clearance 72 communicates with what remains of conventional planar clearance 54. (Again, the sizes of the clearances are somewhat exaggerated for greater clarity in FIG. 2.) Liquid from pump regions 48 and 66 thus flows through clearance 72 to clearance 54 so that both liquid-filled clearances combine to provide a good seal across the end of rotor hub 42 adjacent to port structure 60. Moreover, the effectiveness of this seal is further enhanced by the fact that potential leakage must follow a tortured path through differently oriented clearances 54 and 72, rather than a straight path through only clearance 54 as in the prior art. The addition of clearance 72 and the resulting more tortured leakage barrier allows the area of clearance 54 to be reduced without increased gas leakage. This in turn allows the size of rotor fastener recess 48 to be increased. Increasing the size of recess 48 has the many advantages described above. For example, it may allow a larger fastener 50 to be used. It may decrease the amount by which the diameter of shaft 30 must be reduced for the fastener, thereby strengthening the shaft at its connection to the rotor. As still another especially advantageous possibility, increasing the size of recess 48 may allow a standard, unreduced shaft to be used, with the rotor being fastened to the shaft by a collet-type fastener which can securely grip a completely smooth shaft. This facilitates the use of a standard electric motor to drive the pump, with the rotating shaft of the motor being the drive shaft 30 of the pump.

Figure 3:
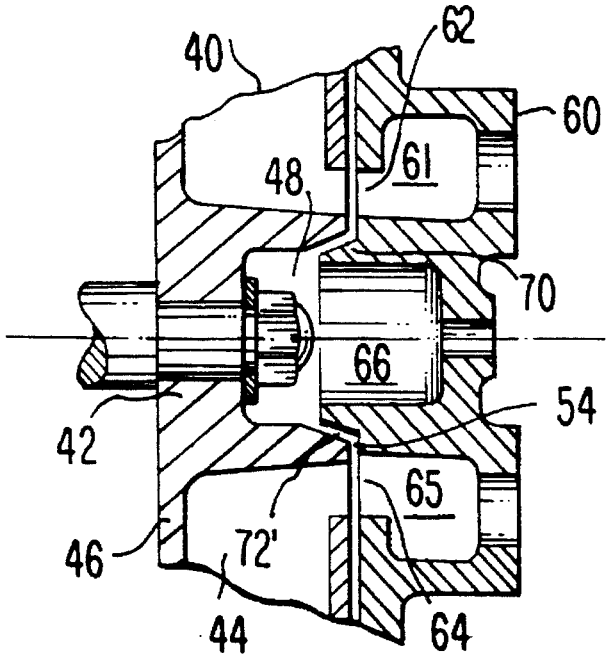
FIG. 3 is another view similar to FIG. 2 showing a second illustrative embodiment of the invention.

FIG. 3 shows an alternative embodiment in accordance with this invention in which the radially outer surface of protrusion 70 is frustoconical rather than cylindrical. This surface mates with a complementary frustoconical interior surface portion of recess 48 so that there is a frustoconical clearance 72' between the mating frustoconical surfaces. The radial dimension of this clearance may be in the range from about 0.002 to about 0.015 inches. Again, the radial dimension of clearance 72' may be selected in part based on the overall size of the pump. (Clearance dimensions are again somewhat exaggerated in FIG. 3 for greater clarity.) As in the case of FIG. 2, clearance 72' fills with liquid from pump regions 48 and 66, and adds to clearance 54 to increase the effectiveness of the liquid seal across the axial end of the rotor hub adjacent to port structure 60. Clearance 72' also combines with clearance 54 to provide a more tortured leakage barrier. Thus again, the addition of clearance 72' makes it possible to increase the size of recess 48 without increasing gas leakage, and possibly even with substantially reduced gas leakage. This has all the advantages described above in connection with FIG. 2.

It will be understood that the foregoing is only illustrative of the principles of this invention, and that various modifications can be made by those skilled in the art without departing from the scope and spirit of the invention. For example, although the invention has been described in the context of pumps which have only one gas inlet port and one gas outlet port (and therefore one pumping cycle per rotor revolution), the invention is equally applicable to pumps having multiple alternating gas inlet and outlet ports (and therefore multiple pumping cycles per rotor revolution).

The invention claimed is:

1. A liquid ring pump comprising:

a rotor mounted for rotation about an axis, said rotor having a hub which extends substantially concentrically about said axis, and a plurality of blades extending radially outward from said hub, each of said blades also extending substantially parallel to said axis, and said blades being spaced from one another about said axis, at least a portion of the space between adjacent blades being open at a first axial end of said rotor in a plane which is substantially perpendicular to said axis to allow gas to enter and leave the spaces between adjacent blades, said hub having a recess which extends axially into said first axial end of said rotor for receiving a fastener which holds said rotor on a shaft which (a) is supported adjacent a second axial end of said rotor remote from said first axial end, (b) extends into said rotor concentric with said axis, and (3) ends at said fastener, said recess defining an annular inner surface of said hub adjacent to said plane, said annular inner surface being substantially concentric with said axis and having an inside diameter transverse to said longitudinal axis large enough to permit said fastener to be axially inserted into or removed from said recess for attachment to or removal from said shaft;

a port structure adjacent to said plane for covering the openings between adjacent blades at said first axial end of said hub except at ports through said port structure which communicate with said openings at predetermined locations about said axis at which gas is to enter and leave the spaces between adjacent blades via said ports, said port structure having a projection which extends axially into said recess, said projection having an annular outer surface which is substantially concentric with and axially overlaps an axial portion of said annular inner surface, said annular inner surface being radially spaced from said axial portion of said annular inner surface by an annular clearance; and a liquid supply conduit for supplying liquid to said clearance to substantially fill said clearance and thereby provide a seal for reducing gas leakage between said openings.

2. The apparatus defined in claim 1 wherein said axial portion of said annular inner surface and said annular outer surface are each substantially cylindrical.

3. The apparatus defined in claim 1 wherein said axial portion of said annular inner surface and said annular outer surface are each substantially frustoconical.

4. The apparatus defined in claim 1 wherein said liquid supply conduit passes through said port member in order to supply said liquid to said clearance via said recess.

5. The apparatus defined in claim 1 wherein said clearance has a radial dimension in the range from 0.002 to 0.015 inches.

* * * * *

UNITED STATES PATENT AND TRADEMARK OFFICE

CERTIFICATE OF CORRECTION

PATENT NO. : 5,507,625

DATED : April 16, 1996

INVENTOR(S) : Carl G. Dudeck

It is certified that error appears in the above-indentified patent and that said Letters Patent is hereby corrected as shown below:

| | |
|---|---|
| Cover Page, item [54]: | Change the title to --LIQUID SEALING ARRANGEMENT FOR LIQUID RING PUMPS--. |
| Cover Page, item [56]: | Change "Haavier" to --Haavik--. |
| Column 1, line 1: | Change the title to --LIQUID SEALING ARRANGEMENT FOR LIQUID RING PUMPS--. |
| Column 3, line 41: | Change "(62)" to --62--. |
| Column 3, line 42: | Change "(64)" to --64--. |
| Column 6, line 26: | Change "inner" (second occurrence) to --outer--. |

Signed and Sealed this

Twenty-fourth Day of September, 1996

*Attest:*

Bruce Lehman

BRUCE LEHMAN

*Attesting Officer*

*Commissioner of Patents and Trademarks*